US006167862B1

(12) United States Patent
Powell et al.

(10) Patent No.: US 6,167,862 B1
(45) Date of Patent: Jan. 2, 2001

(54) AIR CLEANER SYSTEM

(75) Inventors: Jeffrey J. Powell, Windsor; Stephen F. Bloomer, London, both of (CA); Stephen E. Setescak, Regensburg (DE)

(73) Assignee: Siemens Canada Limited, Ontario (CA)

( * ) Notice: Under 35 U.S.C. 154(b), the term of this patent shall be extended for 0 days.

(21) Appl. No.: 09/310,672

(22) Filed: May 12, 1999

(51) Int. Cl.[7] ..... F02M 35/02
(52) U.S. Cl. ..... 123/198 E
(58) Field of Search ..... 123/198 E, 494; 73/118.2; 55/355; 277/918; 285/414

(56) References Cited

U.S. PATENT DOCUMENTS 4,440,555 * 4/1984 Chichester ..... 123/198 E
5,059,221 * 10/1991 McWilliam ..... 123/198 E
5,106,397 * 4/1992 Jaroszczyk et al. ..... 55/355
5,120,334 * 6/1992 Cooper ..... 123/198 E
5,369,990 * 12/1994 Zurek et al. ..... 73/118.2
5,740,774 * 4/1998 Kennedy ..... 123/198 E
5,865,863 * 2/1999 DeSousa et al. ..... 123/198 E

* cited by examiner

*Primary Examiner*—Willis R. Wolfe
*Assistant Examiner*—Hyder Ali

(57) ABSTRACT

A combined air cleaning and flow rate sensing system for the combustion air of an internal combustion engine is disclosed. The system includes a housing providing an inlet and a filter at least partially disposed in the housing. The air cleaner system also includes a conduit adjacent the housing and providing a flange and an outlet. The air cleaner system also includes a compressible seal disposed between the filter and the flange. The air cleaner system also includes a locking mechanism adapted to selectively secure the conduit to the housing such that the seal may be compressed between the conduit and the filter. The air cleaner system also includes an accessory mounted to the conduit. The air entering the inlet exits through the outlet.

1 Claim, 2 Drawing Sheets

AIR CLEANER SYSTEM

FIELD OF THE INVENTION

The present invention relates generally to air induction systems for the combustion air of internal combustion engines. In particular, the present invention relates to air induction systems providing an integral mass airflow sensor, to measure the amount of air flowing through an air cleaner system.

BACKGROUND OF THE INVENTION

It is well known to provide an air cleaner for purifying raw air before mixing the raw air with fuel for combustion in an internal combustion engine. Such known air cleaners are typically used in automobiles. In operation, such known air cleaners provide for the intake of raw air, the purification of the raw air and the routing of the purified air to a cylinder of an internal combustion engine. In fuel injected engines, this flow rate of combustion air is monitored by a mass airflow sensor disposed someplace in the combustion airflow path. These mass airflow sensors are typically calibrated before installation and are inserted into tubes, housings or conduits that communicate with the combustion airflow path. One problem with these sensors is that they are quite sensitive to alignment and orientation. Furthermore, they are easily damaged during replacement and testing. It would be beneficial, therefore, to provide a mass airflow sensor that is coupled to a readily removable conduit that will protect the sensor elements and also more readily permit sensor testing. Since air cleaners are often provided with readily removable conduits to permit the replacement of air filter elements, it would also be advantageous to dispose of the mass airflow sensor in such a conduit associated with the air cleaner.

SUMMARY OF THE PRESENT INVENTION

The air cleaner and mass airflow rate sensing system includes a housing providing an inlet and a filter at least partially disposed in the housing. The system also includes a conduit adjacent the housing and providing a flange and an outlet. The system also includes a compressible seal disposed between the filter and the flange. The system also includes a locking mechanism adapted to selectively secure the conduit to the housing such that the seal may be compressed between the conduit and the filter. The system also includes mass airflow sensor mounted to the conduit.

The present invention further relates to an air induction and mass airflow rate sensing assembly at least partially disposed in a housing of an air cleaner system for purifying air. The housing provides an inlet and the air cleaner system provides a filter at least partially disposed within the housing, a compressible seal and a locking mechanism. The air induction assembly includes a conduit having a first end and adapted for placement at least partially within the housing and the filter such that a second end extends at least partially from the housing. The air induction assembly also includes a flange extending about the circumference of the conduit. The air induction assembly also includes a mass airflow sensor mounted to the conduit. The seal is disposed between the filter and the flange and the locking mechanism is configured to selectively secure the conduit to the housing.

The present invention further relates to an air cleaning and flow rate measuring system. The system includes a filter element for filtering air. The air cleaner system also includes a housing for supporting the filter element and surrounding the filter element. The system also includes an inlet for introducing air into the housing and into the filter element. The system also includes a conduit providing a flange and an outlet and being disposed adjacent to the filter element. The system also includes a seal for inhibiting the leakage of air from the filter element and disposed between the filter element and the housing. The system also includes a locking means for securing the conduit to the seal and to the housing. The system also includes a mass airflow rate sensor mounted to the conduit. Air enters the housing through the inlet, the air is purified by the filter element, and the air exits the housing through the outlet.

It is an object of this invention to provide an air induction assembly that is capable of rapid replacement. It is also an object of this invention to provide a sensor assembly that is easily accessible and capable of rapid testing or calibration. It is a further object of this invention to provide a sensor that readily interfaces with an air filter. Other objects, features and advantages of the invention will become apparent to those skilled in the art upon review of the following FIGURES, the detailed description and the appended claims.

Before explaining in detail at least one preferred embodiment of the invention, it is to be understood that the subject matter recited in the claims is not limited in its application to the details of construction and the arrangement of the components set forth in the following description or shown in the FIGURES. The subject matter recited in the claims is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 1:
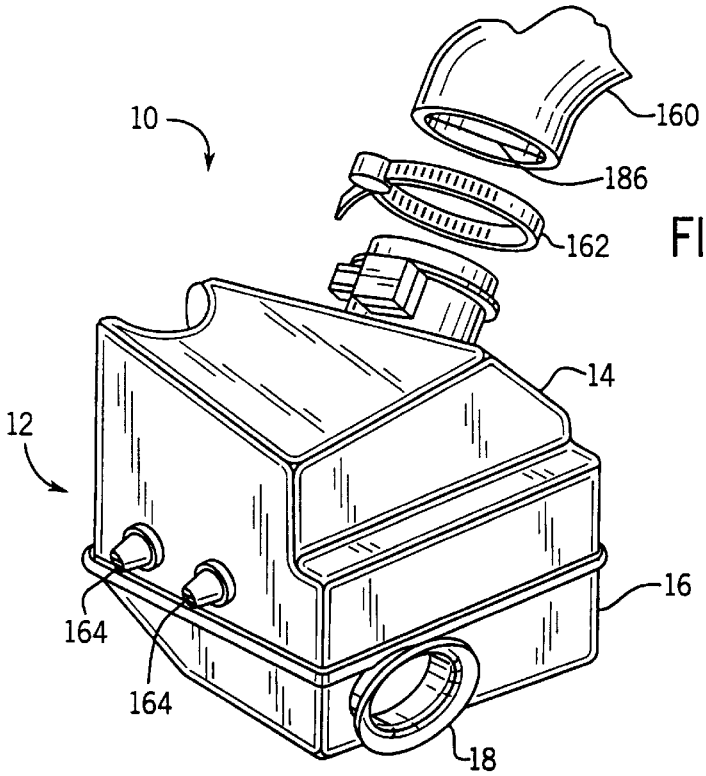
FIG. 1 is a partially fragmentary exploded perspective view of an air cleaner system in accordance with a preferred embodiment of the present invention.

Referring to FIG. 1, an air cleaner system 10 for purifying raw air is shown according to a preferred embodiment of the present invention. System 10 includes an air induction assembly 60 coupled to a replaceable filter assembly 140, which is contained within a housing 12. In the operation of system 10, raw air is drawn from the exterior of housing 12 into a conduit (shown as a snorkel 18). The raw air is directed through filter assembly 140, is purified, and the resulting purified air is directed to an outlet 66 of air induction assembly 60. An arrow 188 shows the general directional flow of the air through air cleaner system 10.

Figure 3:
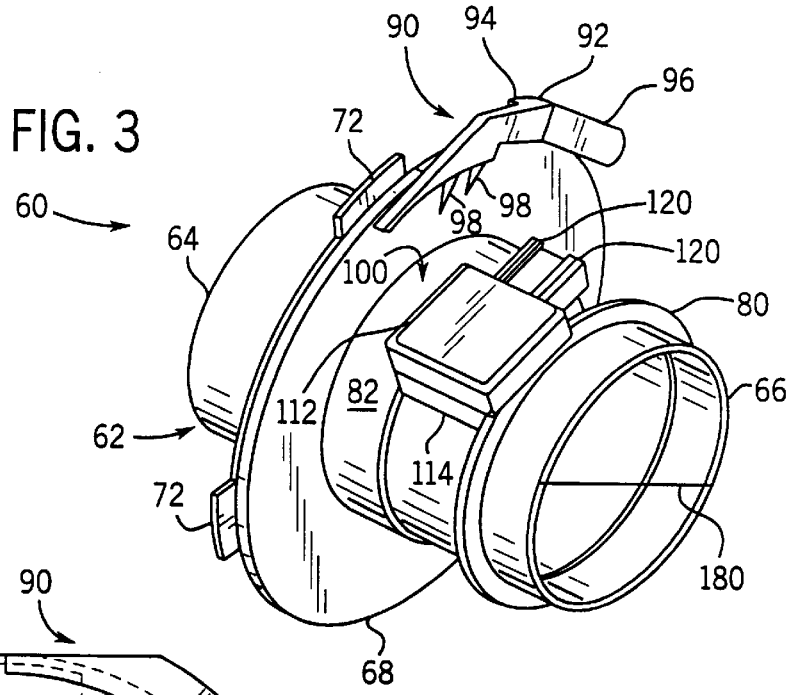
FIG. 3 is a perspective view of an air induction system according to a preferred embodiment of the present invention.

Referring to FIG. 3, air induction assembly 60 is shown according to a preferred embodiment of the present invention. Air induction assembly 60 defines an airflow path for the purified air as indicated by arrow 188. Air induction assembly 60 includes a conduit (shown as tube 62) having an inlet 64 and outlet 66. Inlet 64 of tube 62 is positioned within the interior of housing 12. Outlet 66 of tube 62 extends from the exterior of housing 12. A fastener (shown as a capture clamp 162) secures a conduit (shown as a hose 160) to outlet 66 of tube 62. Hose 160 has an interior diameter 186 greater than an exterior diameter 180 of outlet 66. Hose 160 directs the purified air from outlet 66 to other engine systems (not shown) for processing (e.g., to a carburetor for the mixing of the purified air with fuel, and the eventual placement of the resulting mixture in the cylinder of an internal combustion engine).

Figure 4:
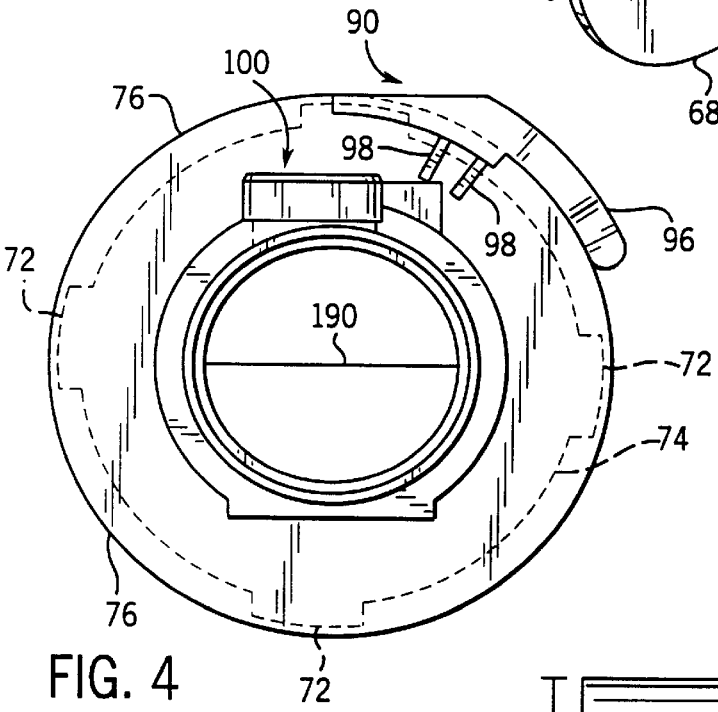
FIG. 4 is a top plan view of the air induction system of FIG. 3.
Figure 5:
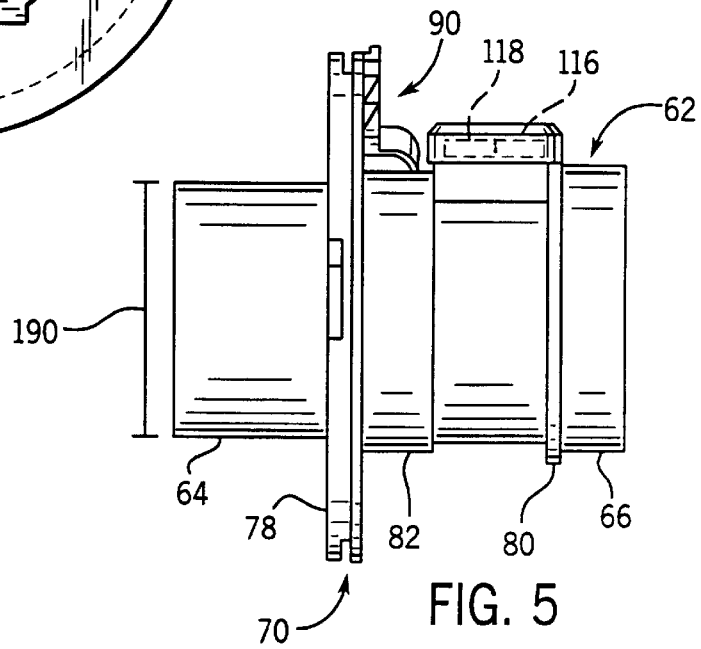
FIG. 5 is a side elevation view of the air induction system of FIG. 3.

Referring to FIGS. 3 through 5, a mass airflow rate sensor assembly (shown as assembly 100) is mounted to the exterior of tube 62. Assembly 100 is positioned between an inward ridge 82 and an outward ridge 80 of tube 62. Assembly 100 includes an upper housing 112 secured to a lower housing 114 that encapsulate a mass airflow rate sensor 116 and a temperature sensor 118. Upper housing 112 and lower housing 114 may serve to protect sensor 116 and temperature sensor 118 from environmental factors (e.g., debris, water, heat, vibration, physical manipulation, damage during shipping, etc.). A detector (not shown) capable of monitoring environmental variables (e.g., combustion air speed, air temperature, air density, air moisture, etc.) extends from lower housing 114 into the interior of tube 62. An electrical conductor (shown as a wire 120) connects assembly 100 to an engine system (not shown) such as a computer. According to any preferred or alternative embodiments as shown in FIGS. 1 through 3, assembly 100 may be integrally mounted to tube 62 and may be provided as a complete unit pre-calibrated to known variables related to tube 62 (such as engine size, air temperature, the geometry of tube 62, the distance between the periphery of tube 62 and the detector, etc.).

Figure 2:
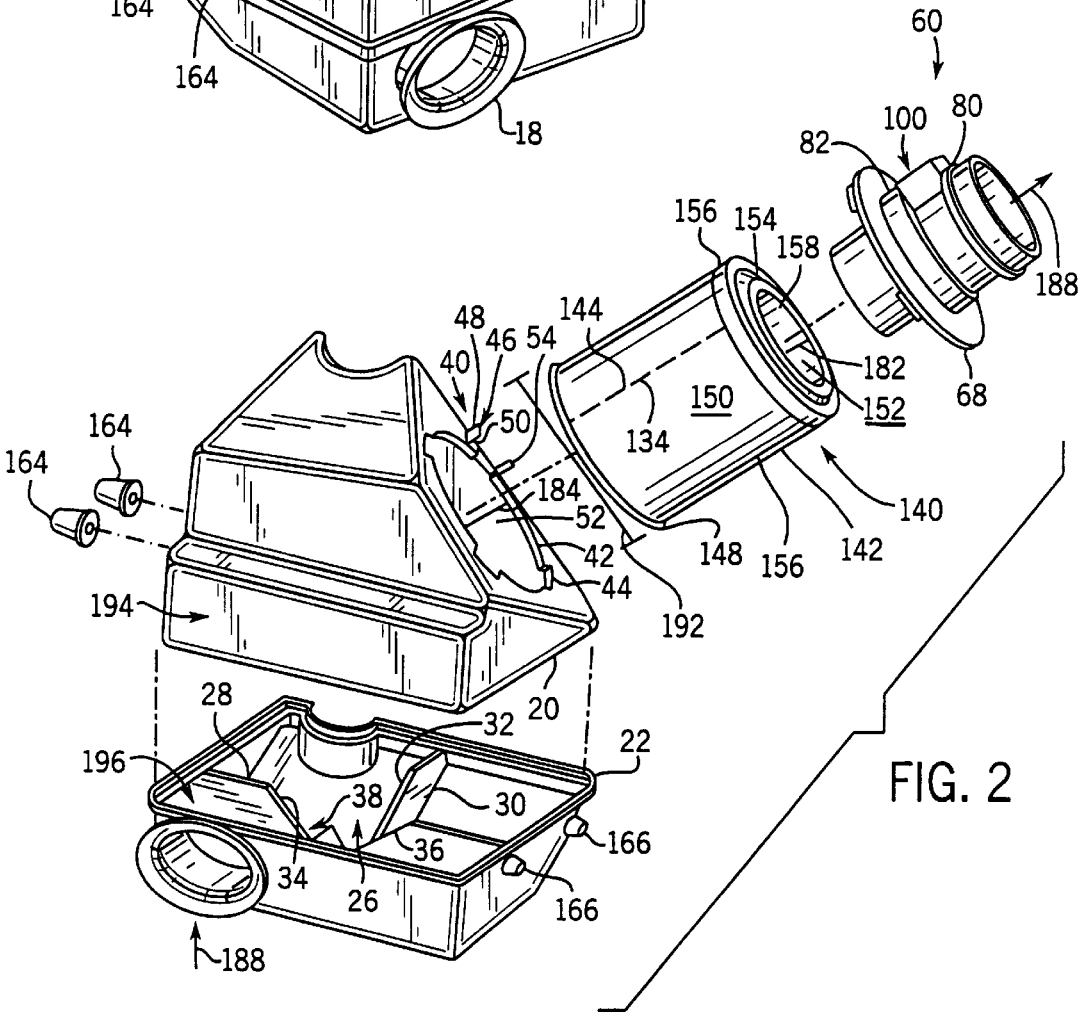
FIG. 2 is a fragmentary exploded perspective view of the air cleaner system of FIG. 1.

Referring to FIG. 2, a generally circular-shaped air filter element (shown as a canister 142) of filter assembly 140 is positioned within the interior of housing 12 and supported by a cradle 26. Canister 142 includes an air receiving surface (shown as an outer wall 150) and an air emitting surface (shown as an inner wall 152). In the operation of system 10, raw air enters canister 142 through outer wall 150 and is directed through a filter media 156 (such as pretreated, pleated corrugated paper). During the purification of the raw air, impurities (e.g., debris, particulates, gasses, dirt, pollution, etc.) may be entrapped in filter media 156. The purified air exits filter media 156 through inner wall 152 of canister 142. A covering (shown as an end cap 148) circumscribes and surrounds the bottom of canister 142. End cap 148 promotes the entry of raw air through outer wall 150 by covering or blocking the lower portion of canister 142. Filter assembly 140 also includes a generally "V"-shaped flexible, compressible seal 154 mounted to the upper portion canister 142. Seal 154 extends radially around an aperture 158 of canister 142. A fastener (not shown), such as an adhesive or glue, may secure seal 154 to canister 142, and may secure a left end 144 of filter media 156 to a right end 134 of filter media 156. Alternatively, seal 154 may be integrally molded to canister 142.

When system 10 is in a fully assembled condition (as shown in FIG. 1), canister 142 is positioned within housing 12, and inlet 64 of tube 62 is positioned within canister 142. An outer diameter 190 of inlet 64 is less than a diameter 182 of an aperture 158 of canister 142. A diameter 184 of an aperture 52 of an upper shell 14 of housing 12 is greater than an outer diameter 192 of end cap 148, and outer diameter 190 of inlet 64 is less than diameter 182 of aperture 158 of canister 142. (See FIG. 2.)

A flange 68 integrally mounted to tube 62 extends about the periphery of tube 62. A housing connector system 40 of upper shell 14 secures filter assembly 140 to a conduit connector system 70 of flange 68. Housing connector system 40 and conduit connector system 70 may serve to compress seal 154 and form a closure or connection between filter assembly 140 and air induction assembly 60 such that air is inhibited from bypassing canister 142. Housing connector system 40 includes outwardly extending protrusions (shown as fingers 42) and inwardly extending indentations (shown as fingers 44) spaced generally evenly about the periphery of aperture 52 of upper shell 14. Conduit connector system 70 includes reciprocal outwardly extending protrusions (shown as fingers 72) and inwardly extending indentations (shown as fingers 74) spaced generally evenly about the periphery of flange 68 of tube 62. Conduit connector system 70 also includes a cover 76 positioned over fingers 74 (see FIG. 4). To create the effective closure or connection between filter assembly 140 and air induction assembly 60, a compressive force is applied to air induction assembly 60 to compress seal 154 between a seal engaging surface 78 of flange 68 and canister 142. Fingers 72 of conduit connector system 70 are aligned with and inserted into fingers 44 of housing connector system 40. Tube 62 is rotated relative to upper shell 14 (or vice versa) such that fingers 72 of conduit connector system 70 are positioned below fingers 42 of housing connector system 40 (i.e., the fingers of the housing connector system and the conduit connector system are rotated until they are intertwined and interconnected) and cover 76 is positioned over fingers 44 of housing connector system 40. The compression of seal 154 and the interconnection of the fingers 42 and fingers 72 maintain such compressive force.

A locking system 90 inhibits further rotation of tube 62 relative to upper shell 14 (such rotation may cause a disconnection between fingers 42 of housing connector system 40 and fingers 72 of conduit connector system 70). Locking system 90 includes a ramp 46 mounted to the exterior of upper shell 14 and positioned adjacent to the periphery of aperture 52. Ramp 46 includes an inclined surface 48 and a vertical surface 50, which is orthogonal to fingers 42 of upper shell 14. To secure locking system 90 in a closed position, tube 62 is rotated relative to upper shell 14 (or vice versa) such that a glide 92 mounted to flange 68 slides over inclined surface 48 of ramp 46. Tube 62 is rotated until a catch 94 of glide 92 passes beyond vertical surface 50 of ramp 46. Further rotation of glide 92 is inhibited by a vertically extending protrusion (shown as a stop 54), which is positioned orthogonal to fingers 42 of shell 14. Thus, when locking system 90 is in the closed position, glide 92 is secured between vertical surface 50 of ramp 46 and stop 54. To release locking system 90 from the closed position to an opened position, a force is exerted on a stem 96 of glide 92 to lift stem 96 above both vertical surface 50 and stop 54 such that tube 62 may be further rotated. Upon such further rotation of tube 62, fingers 42 of housing connector system 40 and fingers 72 of conduit connector system 70 become nonaligned and disconnected such that the closure or seal between seal engaging surface 78 of flange 68 and canister 142 is broken. According to an alternative embodiment as shown in FIGS. 3 and 4, locking system 90 may include reinforcing tabs 98 to secure flange 68 to glide 92.

Referring to FIG. 2, housing 12 includes upper shell 14 mounted to a lower shell 16. Upper shell 14 includes a cavity (shown as a reservoir 194) and aperture 52 for receiving filter assembly 140 in reservoir 194. A downward sealing surface 20 engages an upward sealing surface 22 of lower shell 16. Lower shell 16 includes a cavity (shown as a reservoir 196) for the housing or encapsulation of filter assembly 140. A support structure (shown as cradle 26) provides support to canister 142. Cradle 26 includes a radial support (shown as a flange 28) and a transverse support (shown as a flange 30). A generally "U"-shaped indent 32 of flange 30 provides a surface upon which outer wall 150 of canister 142 may rest. A generally "V"-shaped indent 38 of flange 28 (having a bottom leg 34 and a side leg 36) provides a surface upon which the lower portion of canister 142 may rest, such that bottom leg 34 supports end cap 148 of canister 142 and side leg 36 supports outer wall 150 of canister 142. According to other alternative embodiments as shown in FIGS. 1 and 2, upper shell 14 may include apertures (not shown), which provide a convenient mounting point for mounting elements such as an air or fluid shock mounting (shown as a grommet 164). According to any preferred or alternative embodiment, the exterior of the upper shell may include surface textures to provide additional support to the housing and to assist in the channeling of elements (e.g., air, water, debris, etc.) across the housing.

According to a particularly preferred embodiment, the air cleaner system is used to purify raw air before the raw air is routed to an automotive or vehicular engine. The upper shell and the lower shell of the air cleaner system are preferably constructed of plastic that are vibration welded together at about 120 hertz. The hose mounted to the air induction assembly is preferably made of polyvinylchloride (PVC). The filter element is preferably constructed of paper folded in a zigzag configuration. The end cap is preferably constructed of aluminum metal and encapsulated in urethane. The seal is preferably generally "V"-shaped and constructed of urethane rubber. The accessory is preferably a mass airflow sensor, which measures the amount of raw air purified by the air cleaner, that is pre-calibrated to the geometry of the air induction assembly (e.g., by running a known airflow through the conduit and accounting for various environmental factors such as air speed, air temperature, the diameter of the conduit, the type of engine associated with the air induction assembly, etc.).

It should be noted that the use of the term "conduit" is not meant as a term of limitation, insofar as any valve, hose, tube or like structure providing a channel or passageway through which air may flow is intended to be included in the term. It should also be noted that the use of the term "directed" is not meant as a term of limitation, insofar as any routing or leading of raw or purified air into, through and out of the air cleaner system is intended to be included in the term. It should also be noted that the use of the term "engine system" is not meant as a term of limitation, insofar as any "engine" or like machine for using fuel to produce motion or accompanying accessory (e.g., catalytic convert, carburetor, cylinder, fuel injection system, computer system, fan, etc.) is intended to be included in the term.

While a preferred embodiment of the invention is as described above, there are several substitutions that may be made without departing from the beneficial features of the above-described invention such as variations in sizes, structures, shapes and proportions of the various elements, values of parameters, mounting arrangements, or use of materials. For example, the mounting of the upper shell and the lower shell of the housing may be replaced with such well known substitutions as an interlocking tab and slot arrangement (which would have the added benefit of permitting the upper shell to be removed entirely from the lower shell), the hinging of the upper shell to the lower shell (which would permit the shells to be pivotally opened and closed), or other suitable fastening devices (such as welding, ultrasonic welding, vibration welding, glue, screws, rivets, clamps or other conventional methods) or the housing may be provided as a single piece. The aperture in the upper shell may be provided in either or both of the shells.

According to other alternative embodiments associated with the filter assembly, the filter element may be disposable. The filter material may be constructed of a porous material (e.g., cardboard, corrugated paper, carbon block, etc.) or a natural or synthetic fibrous material (e.g., spun polyethylene, glass wool, microbial filter, etc.). The effective closure or seal between the air induction assembly and the housing may be formed by any known connection system (such as a bayonet connector system, a threaded connection, a clamp, etc.) and may be maintained by any locking mechanism (e.g., a detent, a tumbler lock, a tacky adhesive, etc.). The seal may be mounted to the upper shell, fixed to a rigid or semi-rigid framework that also extends about the periphery of the filter element, or detached from both the upper shell and the filter element. The seal may be positioned between the filter and the air induction assembly or between the air induction assembly and the housing. The inlet of the air induction assembly may be positioned in close proximity to the filter element or a space may be provided between the inlet of the air induction assembly and the filter element. Likewise, the filter element may be positioned in close proximity to the periphery of the aperture of the upper shell or a space may be provided between the filter element and the periphery of the aperture of the upper shell. The base of the lower shell may support the bottom portion of the filter element.

According to other alternative embodiments associated with the air induction assembly, the air induction assembly may be disposable or selectively removable from the filter assembly. A screen of geometric cells (e.g., hexagonal cells) may cover the conduit or a flow straighter may be provided within the conduit to inhibit the formation of undesirable airflow (e.g., eddies) around the detector. A vapor management valve may be provided in the flow path of the air induction assembly. The accessory may be permanently or removably mounted to the air induction assembly. Such mounting of the accessory may be integral (such as by the use of potting compounds or adhesives) or removable (such as by known fastening devices). The accessory and the detector may be mounted at any position on the conduit or may be positioned either upstream or downstream from the airflow path through the conduit.

Thus, it should be apparent that there has been provided in accordance with the present invention an air cleaner system that fully satisfies the objectives and advantages set forth above. Although the invention has been described in conjunction with specific embodiments thereof, it is evident that many alternatives, modifications and variations will be apparent to those skilled in the art. Accordingly, the invention is intended to embrace all such alternatives, modifications and variations that fall within the spirit and broad scope of the appended claims. Other substitutions, modifications, changes and omissions may be made in the design, operating conditions and arrangement of the preferred embodiments without departing from the spirit of the invention as expressed in the appended claims.

What is claimed is:

1. An air induction assembly at least partially disposed in a housing of an air cleaner system for purifying air, the housing providing an inlet, the air cleaner system providing a filter at least partially disposed within the housing, a compressible seal and locking mechanism, the air induction assembly comprising:

a conduit having a first end and adapted for placement at least partially within the housing and the filter such that a second end extends at least partially from the housing;

a mass airflow sensor mounted to the conduit;

a flange coupled to and extending about the circumference of the conduit via a locking mechanism comprised of a plurality fingers extending outward from the flange and a plurality of fingers extending inward about the circumference of an aperture of the housing such that the outwardly extending fingers align with the inwardly extending fingers to form a locking interconnection when the conduit is rotated, and further including a catch configured to selectively release the locking mechanism; and a seal disposed between the filter and the flange.

* * * * *